US006234249B1

(12) United States Patent
Andersen et al.

(10) Patent No.: US 6,234,249 B1
(45) Date of Patent: May 22, 2001

(54) DEVICE FOR USE WITH A RETRIEVABLE BRIDGE PLUG

(75) Inventors: Frode Andersen, Heimdal; Dag Ravn Pedersen, Narvik, both of (NO)

(73) Assignees: Bronnteknologiutvikling AS, Trondheim; Maritime Well Service AS, Forus, both of (NO)

( * ) Notice: Subject to any disclaimer, the term of this patent is extended or adjusted under 35 U.S.C. 154(b) by 0 days.

(21) Appl. No.: 09/355,634

(22) PCT Filed: Jan. 13, 1998

(86) PCT No.: PCT/NO98/00009

§ 371 Date: Jul. 30, 1999

§ 102(e) Date: Jul. 30, 1999

(87) PCT Pub. No.: WO98/35130

PCT Pub. Date: Aug. 13, 1998

(30) Foreign Application Priority Data

Feb. 6, 1997 (NL) ..... 970561

(51) Int. Cl.[7] ..... E21B 33/12
(52) U.S. Cl. ..... 166/118; 166/134
(58) Field of Search ..... 166/118, 134, 166/136–138, 135, 179

(56) References Cited

U.S. PATENT DOCUMENTS

| | | | | |
|---|---|---|---|---|
| 3,706,342 | * | 12/1972 | Woolley | 166/134 |
| 4,554,973 | * | 11/1985 | Shonrock et al. | 166/192 |
| 4,588,029 | * | 5/1986 | Blizzard | 166/120 |
| 5,010,958 | * | 4/1991 | Meek et al. | 166/382 |

* cited by examiner

*Primary Examiner*—Roger Schoeppel
(74) *Attorney, Agent, or Firm*—Alix, Yale & Ristas, LLP

(57) ABSTRACT

A device for use with a retrievable bridge plug (30) comprising an upper packer element (3) and a lower packer element (11). The upper element (3) is connected to an upper link (6), which can rotate around a first pin (5). Upper link (6) is rotatably connected to a lower link (8) by a second pin (7). Lower link (8) can rotate around a third pin (9). An angle ($\alpha$) is formed between the longitudinal axis of the bridge plug and a line extending through the first pin (5) and the second pin (7), and correspondingly through the second pin (7) and the third pin (9), which is greater than zero when upper link (6) and lower link (8) is drawn. Upper link (6) and lower link (8) are arranged for, at setting, to expand radially by compression of upper packer bracket (3) against lower bracket (12), for forming a mechanical barrier for upper packer element (3) and lower packer element (11).

6 Claims, 5 Drawing Sheets

DEVICE FOR USE WITH A RETRIEVABLE BRIDGE PLUG

CROSS-REFERENCE TO RELATED APPLICATIONS

This is the national stage of International Application No. PCT/NO98/00009 filed Jan. 12, 1998 which claims priority from Norwegian Patent Application No. 970561 filed Feb. 6, 1997.

BACKGROUND OF THE INVENTION

The present invention concerns generally retrievable bridge plugs, but more specifically a drawable mechanical barrier having a packer element, according to the introductory part of patent claim 1.

Among other things, bridge plugs are used for oil- and gas wells. Such bridge plugs have a packer element which seals against fluid and pressure. The packer element is comprised mainly of an elastic rubber body sealing against the pressure, and mechanical barriers preventing extrusion of the rubber at pressure load. In oil and gas wells the bridge plug will, in many cases, have to pass restrictions such as, for example, valves and nipples, for subsequent location in a larger diameter. Known retrievable bridge plugs have a limited degree of expansion at a high pressure and a high temperature. The limitation in the degree of expansion is mainly caused by the construction of the drawable mechanical barrier.

SUMMARY OF THE INVENTION

It is thus an object with present invention to provide a drawable mechanical barrier, which stabilizes and prevents extrusion of the packer elements at high pressure/temperature and has a large degree of expansion.

The object of the invention is achieved by a device having features as stated in the characterizing part of patent claim 1. Further features are stated in the dependent claims.

According to the invention, a mechanical barrier is developed, which through an axial movement is expanded and then drawn through an opposite movement.

In some oil and gas wells it is desirable that the bridge plug changes pressure direction from one side to the other side. In this case, two packer elements are installed, having a mechanical barrier inbetween. When the packer elements are expanded, the rubber will be forced out radially along the mechanical barrier, and up against the casing. In expanded position, the mechanical barrier has a wedge shape up against the casing. By applying pressure, the packer element will creep into the radial wedge shape, and seal. This wedge shape also has a positive effect to the sealing property of the packer element at increasing pressure load. If the bridge plug should seal against differential pressure from one side, a mechanical barrier with a packer element is installed at the pressure side.

Upon expansion of two packer elements with a mechanical barrier inbetween, a fluid volume will form between the packer elements. When one of the packer elements is pressurized, it will move and cause a pressure build-up on the enclosed volume. This pressure build-up will again cause a movement of the packer element at the non-pressure side. This involves an extra strain on the packer element at the non-pressure side, and is unfortunate, however. This is solved by draining unwanted fluid volume causing pressure build-up. Drainage is performed by way of U-shaped packers installed in a packer bracket at the non-pressure side.

These U-shaped packers act as check valves, and are described below.

When setting the bridge plug in horizontal oil and gas wells, the mechanical barrier positions the mechanical bridge plug in the centre, and thus avoids the extra strain on the packer element from the bridge plug's own weight.

When drawing the bridge plug from the well, the mechanical barrier according to the present invention has a construction whereby it is possible to be actively drawn when running into restrictions. This is performed when the mechanical barrier is subjected to tension, which then leads to the link pairs rotating around their belonging bolts, thus forcing them against the centre of the bridge plug.

According to the present invention, the mechanical barrier has a construction making it functionally reliable during the aggregation of sand above the bridge plug. The mechanical barrier being situated between two packer elements is advantageous in this respect.

BRIEF DESCRIPTION OF THE DRAWINGS

In the following, the invention will be explained further by means of examples of embodiments and with reference to the accompanying drawings, where.

DETAILED DESCRIPTION OF THE PREFERRED EMBODIMENT

Figure 1:
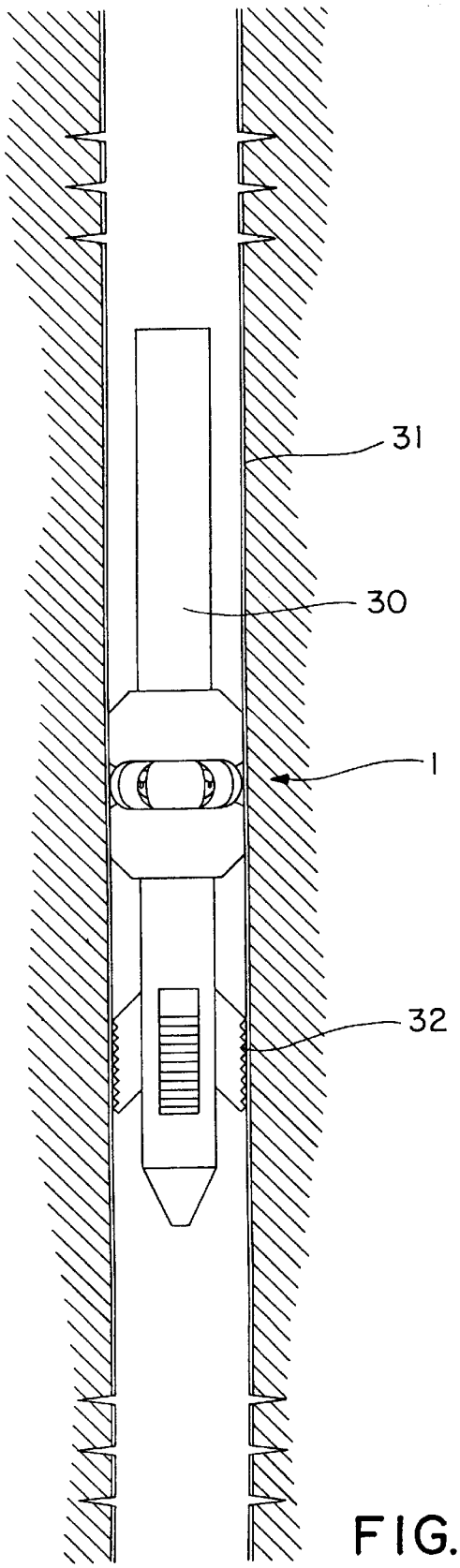
FIG. 1 shows a sketch of a retrievable bridge plug with packer elements having a mechanical barrier according to present invention.

FIG. 1 shows a sketch of a retrievable bridge plug, generally denoted 30, set in a casing 31 in a horizontal well. The bridge plug 30 comprises an anchoring part 32 and a mechanical barrier 1 with packer elements, which are expanded against the casing 31.

Figure 2:
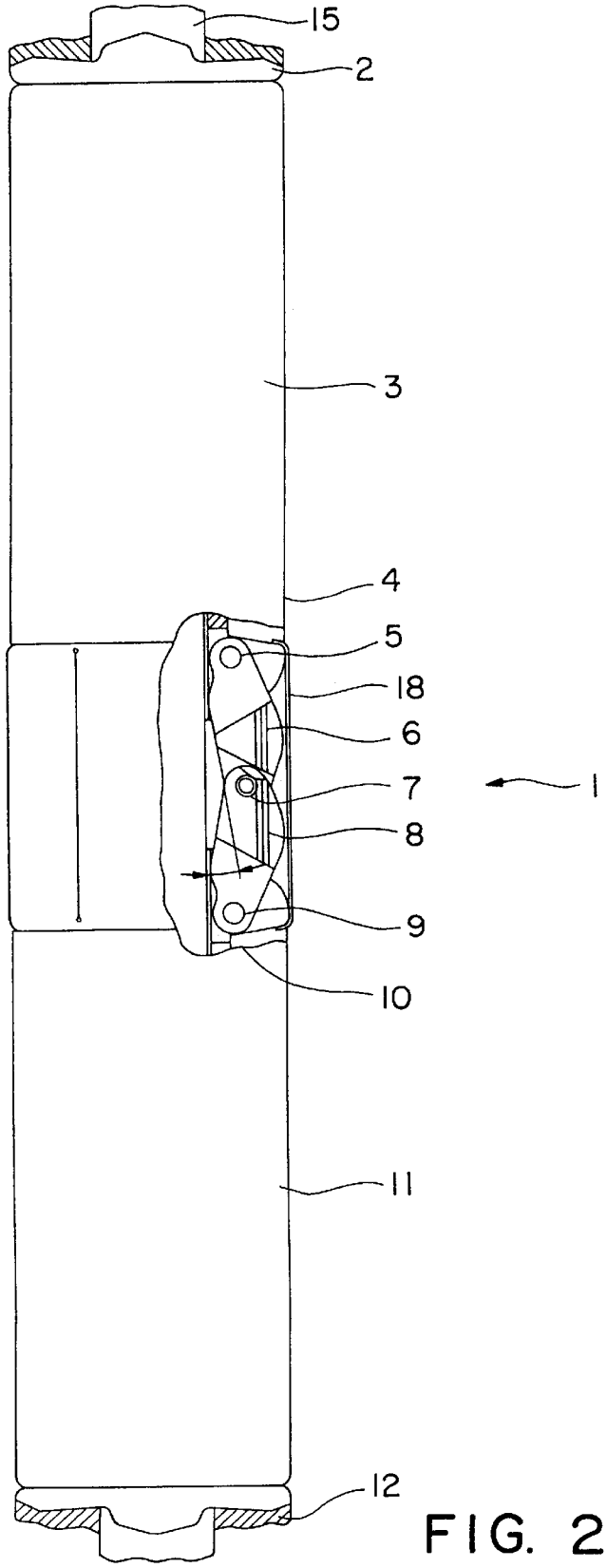
FIG. 2 shows a partly sectioned view of packer elements with a mechanical barrier according to present invention, in drawn (not expanded) condition.

FIG. 2 illustrates a device according to the present invention, in the form of a mechanical barrier 1 having two packer elements 3, 11 which are arranged at the bridge plug (not shown in FIG. 2), in order to be inserted in, and expanded in the casing (not shown in FIG. 2). The device includes a through axle 15 with an external upper packer bracket 2, connecting the upper end (not shown) with upper packer element 3. The upper packer element 3 is connected through an upper clamping section 4 via first pin 5 to an upper chain 6. The upper chain 6 is rotatably connected with lower link 8 by a second pin 7. The lower chain 8 is connected to a lower clamping section 10 by a third pin 9. Lower clamping section 10 is connected with the lower packer element 11 that is then connected with the lower end of the bridge plug, through a lower packer clamp 12. Within upper clamping section 4 is connected a thin, flexible pipe 18, which forms an expandable cover over the rotatable link pairs 6 and 8, and is the connected to lower clamping section 10.

In FIG. 2, the device according to the present invention is shown with the mechanical barrier 1 and the packer elements 3, 11 in drawn (not expanded) condition. An angle α is formed through the longitudinal axis of the bridge plug and a line extending between first pin 5 and second pin 7. The angle α is larger then zero, and preferably less then 45° when the mechanical barrier is in this drawn condition.

Figures 3, 3A:
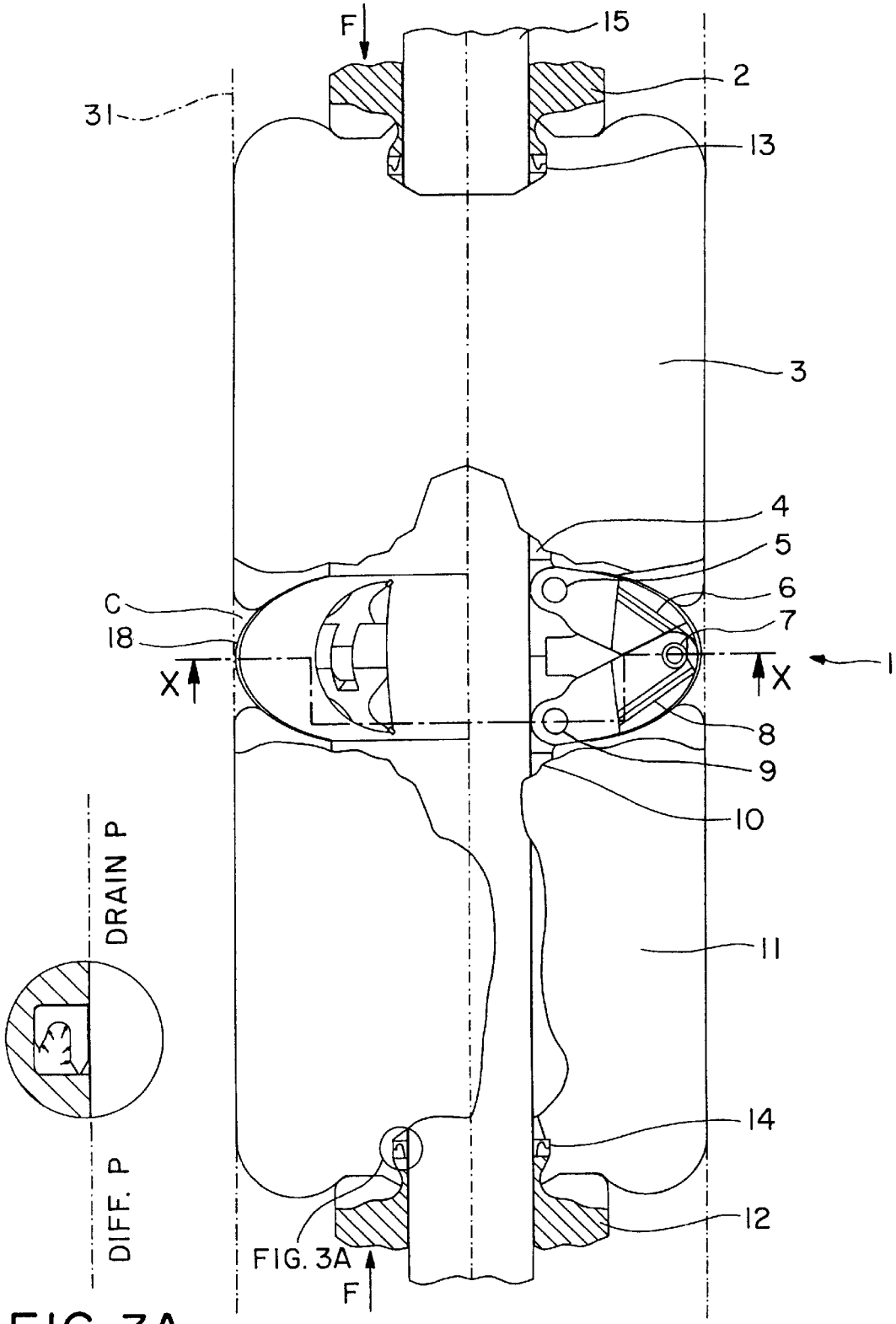
FIG. 3 shows packer elements with the mechanical barrier in FIG. 2 in expanded condition.
FIG. 3*a* shows a detail of the packer element in FIG. 3.

In FIG. 3, the device is shown in expanded position, where upper packer bracket 2 is forced against lower packer bracket 12 with the result that upper packer element 3 is compressed and expanded radially. The axial force propagates further down to the upper link 6 that due to the angle of departure α (FIG. 2) will rotate around the pin 5 and tip out radially. This will cause the split pipe 18 to bend outwards and be formed around the periphery of the link pairs 6 and 8. When upper chain 6 and lower link 8 are compressed, the lower clamping section 10 will compress the packer element 11 which then will expand radially.

An upper U-shaped packer 13 is installed in the upper clamping section 2 and a lower U-shaped packer 14 is installed in the lower clamping section 12. Upper U-shaped packer 13 has the function of sealing when the packer element 3 is pressurized, and to drain an enclosed volume C when the packer element 11 is pressurized. Lower U-shaped packer 14 is shown in detail in FIG. 3*a*. Lower U-shaped packer 14 has the function of sealing when the packer element 11 is pressurized, and to drain the enclosed volume C when the packer element 3 is pressurized.

Figure 4:
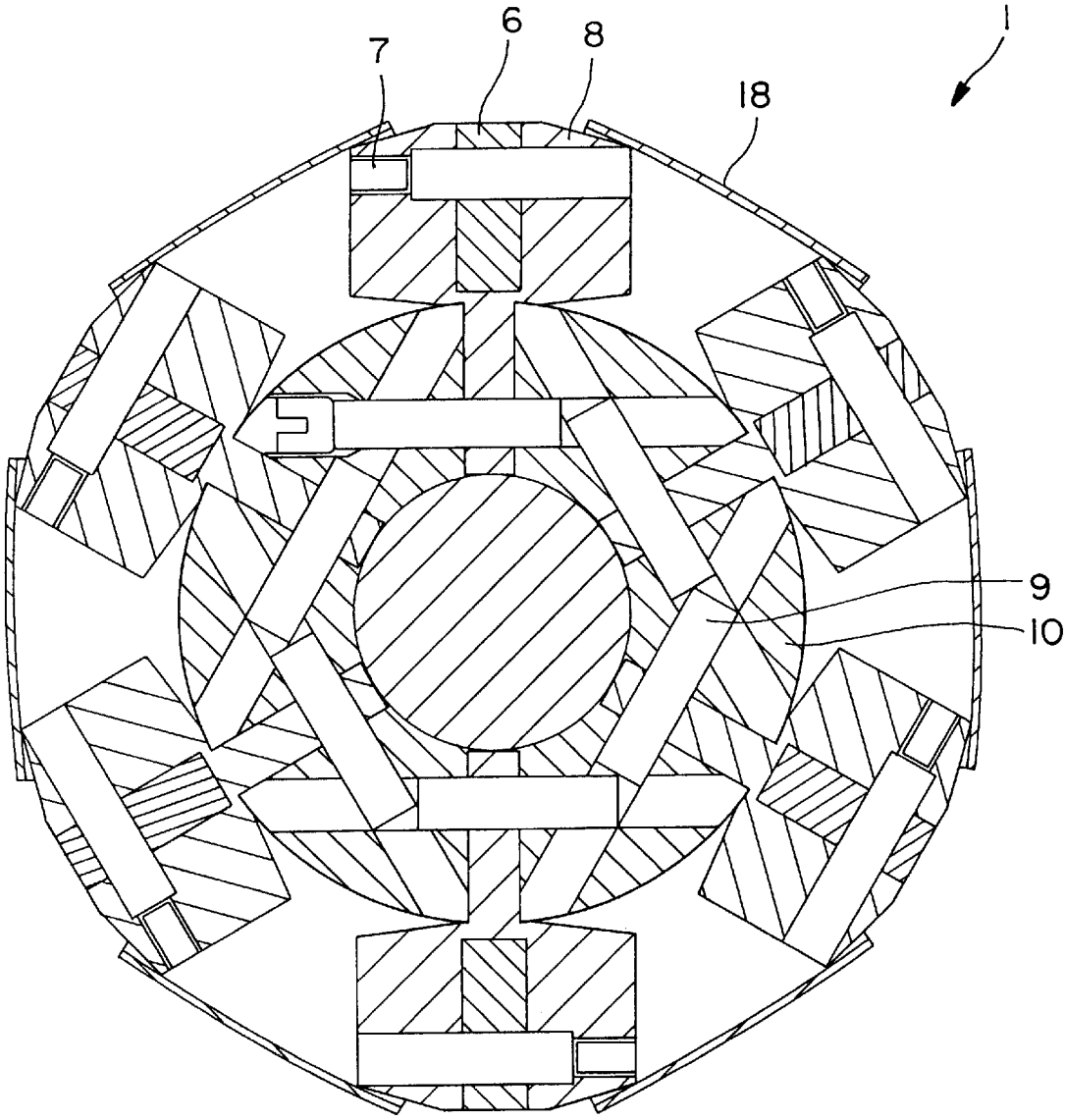
FIG. 4 shows a section of the mechanical barrier in FIG. 3, viewed along the line X—X.

FIG. 4 shows a section view of the mechanical barrier 1 in expanded condition. The pipe 18 is split in a number corresponding to the number of rotatable link pairs 6 and 8. The pipe 18 is oriented in relation to link pairs 6 and 8, so that each axial split of the pipe 18 is situated above the middle of each link pair 6 and 8. In expanded condition, the split pipe 18 is supported by the link pairs 6, 8, so that the mechanical barrier in expanded condition forms a completely sealed barrier.

Figure 5:
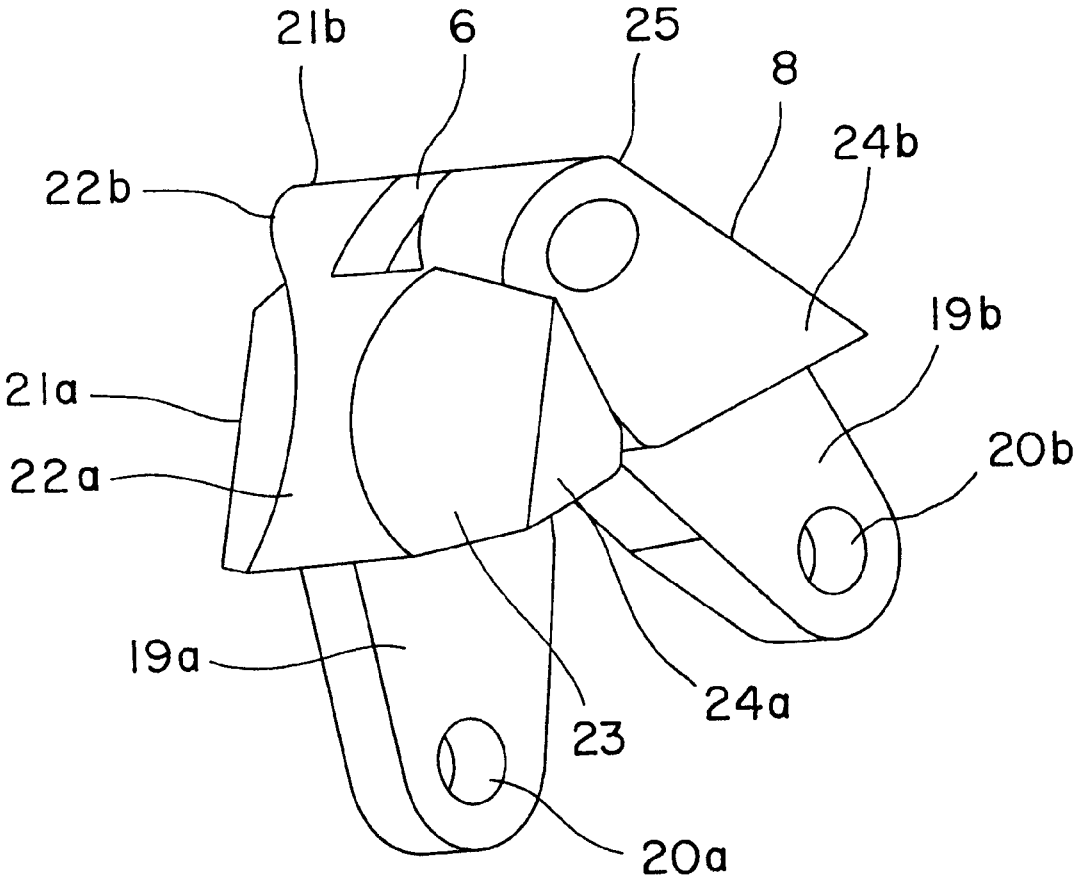
FIG. 5 shows a perspective view of a link pair located by the mechanical barrier in FIG. 3.

FIG. 5 shows a link pair comprising rotatable link 6 and rotatable chain 8. The link pair 6, 8 is shown in expanded condition, and without belonging pins. Each of the links 6, 8 is comprised an arm section 19*a*, 19*b* with belonging holes 20*a*, 20*b* for first and third pin 5 and 9, respectively. The arm sections 19*a*, 19*b* are rigidly connected to head section 21*a*, 21*b*. The head sections 21*a*, 21*b* are at their upper end, formed so that the links 6, 8 can engage each other, as the second pin (not shown) is brought through hole 25 at the upper end. The head sections 21*a*, 21*b* have profiled support surfaces 22*a*, 22*b* that are rounded in the axial direction of mechanical barrier 1. The support surfaces 22*a*, 22*b* recede into inclined covering surfaces 23, which again recede into inclined end surfaces 24*a*, 24*b*.

The links 6, 8 are constructed so that they, in expanded condition, shall form as large an external supporting surface as possible, in order to give the best possible support for the split pipe 18. Thus, the links 6, 8 and the split pipe 18 form a complete barrier against the packer elements 3, 11. The optimum width of the link pairs 6, 8 is the length of the cord belonging to the arc calculated from the circumference of unexpanded bridge plug divided by the number of link pairs 6, 8. Where the width is the distance between the two external limitations of the links 6, 8, consisting of the points where the inclined cover surface 23 recedes to inclined end surfaces 24*a*, 24*b*. The desired expansion height of a link pair 6, 8, corresponding to the radial distance between the unexpanded bridge plug 30 and the inner wall of the casing 31, determines the height of the head sections 21*a*, 21*b*.

The links 6, 8 are constructed for achieve a large mechanical strength, so that they can bear the influence from the pressure forces that can occur. In order to achieve an optimum combination of mechanical strength and size of the supporting surface, the end surfaces 24*a*, 24*b* are shaped with an inclination as described above.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. Device for use with a retrievable bridge plug disposed within a casing, the device comprising a through axle defining a longitudinal axis, an external upper packer bracket that is connected with an upper packer element, and an external lower packer bracket that is connected with a lower packer element, the improvement comprising that:

the upper packer element is connected through an upper clamping section to an upper link, the upper link being rotatably connected with the upper clamping section by a first pin, the upper link is rotatably connected to a lower link by a second pin, and the lower link is rotatably connected to a lower clamping section by a third pin, wherein an angle is formed between the longitudinal axis of the bridge plug and a line extending through the first pin and the second pin, and correspondingly through the second pin and the third pin, the angle being greater then zero when the upper link and the lower link are drawn, the upper link and the lower link being arranged for, at setting, to bias the upper packer bracket against the lower packer bracket, whereby the upper and lower packer elements expand radially by compression to form a mechanical barrier.

2. Device according to claim 1, wherein the upper link and the lower link define a link pair, the link pair being covered by a flexible split pipe, the split pipe in expanded condition together with the link pair forming a mechanical barrier that forms a sealed wall between the casing and the bridge plug.

3. Device according to claim 1, further comprising a plurality of upper and lower link pairs arranged around the circumference of the axle.

4. Device according to claim 1, further comprising an upper U-shaped packer installed in the upper clamping section, the upper U-shaped packer being arranged for sealing an enclosed volume when the upper packer element is pressurized and for draining the enclosed volume when the lower packer element is pressurized.

5. Device according to claim 3, wherein there are two, three, four, five, or six link pairs.

6. Device according to claim 4, further comprising a lower U-shaped packer installed in the lower clamping section, the lower U-shaped packer being arranged for sealing the enclosed volume when the lower packer element is pressurized and for draining the enclosed volume when the upper packer element is pressurized.

* * * * *